US008894435B2

(12) United States Patent
Behziz et al.

(10) Patent No.: US 8,894,435 B2
(45) Date of Patent: Nov. 25, 2014

(54) SENSE PIN FOR AN ELECTRICAL CONNECTOR

(71) Applicant: Tyco Electronics Corporation, Berwyn, PA (US)

(72) Inventors: Arash Behziz, Newbury Park, CA (US); Michael David Herring, Apex, NC (US); Jason M'Cheyne Reisinger, Carlisle, PA (US); William Charles McGee, III, Lincoln, CA (US); Susan Elaine Wright, Harrisburg, PA (US); David A. Trout, Lancaster, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 58 days.

(21) Appl. No.: 13/784,136

(22) Filed: Mar. 4, 2013

(65) Prior Publication Data

US 2014/0248792 A1 Sep. 4, 2014

(51) Int. Cl.
*H01R 3/00* (2006.01)
*H01R 13/66* (2006.01)

(52) U.S. Cl.
CPC ..... *H01R 13/6683* (2013.01)
USPC ..... 439/489

(58) Field of Classification Search
CPC ..... H01R 13/641; H01R 13/6272; H01R 13/639; H01R 13/7032; H01R 13/64; H01R 13/6683; H04Q 1/149
USPC ..... 439/489, 490, 188
See application file for complete search history.

(56) References Cited

U.S. PATENT DOCUMENTS

| | | | | |
|---|---|---|---|---|
| 6,755,681 | B2 * | 6/2004 | Chen | 439/489 |
| 2011/0039445 | A1 | 2/2011 | Boyd et al. | |
| 2012/0081102 | A1 | 4/2012 | Gao et al. | |

FOREIGN PATENT DOCUMENTS

| | | | |
|---|---|---|---|
| DE | 102011050638 | A1 | 3/2012 |
| EP | 1455423 | A1 | 9/2004 |
| JP | 2006107863 | A | 4/2006 |

OTHER PUBLICATIONS

European Search Report issued in corresponding application No. EP 14156945 on Jun. 4, 2014.

* cited by examiner

*Primary Examiner* — Javaid Nasri

(57) ABSTRACT

An electrical connector is provided for mating with a mating connector. The electrical connector includes a housing and electrical contacts held by the housing. The electrical contacts are configured to mate with corresponding mating contacts of the mating connector. A sense pin is held by the housing and is configured to mate with a corresponding mating contact of the mating connector. The sense pin extends a length that includes a tip segment and a sensing segment. The tip and sensing segments have different electrical characteristics. The tip segment includes a tip of the sense pin. The tip segment extends between the sensing segment and the tip such that the sensing segment is offset from the tip along the length of the sense pin. The sensing segment is configured to indicate that the electrical contacts and the mating contacts are de-mated by more than a predetermined de-mating distance.

16 Claims, 6 Drawing Sheets

SENSE PIN FOR AN ELECTRICAL CONNECTOR

BACKGROUND OF THE INVENTION

The subject matter herein relates generally to electrical connectors, and more particularly, to sense pins for electrical connectors.

As a mated pair of electrical connectors are de-mated (i.e., separated) from each other, the electrical contacts of the electrical connectors may remain engaged in physical and electrical contact before the electrical connectors are fully de-mated from each other. For some known electrical connector assemblies, the electrical performance of the assembly will degrade when the electrical connectors are de-mated beyond a de-mating distance that is less than the fully de-mated distance. For example, the amount of electrical power and/or the speed, strength, and/or number of electrical signals transmitted through the assembly may be reduced.

Some electrical connector assemblies include sense pins for indicating whether the electrical contacts of a mated pair of electrical connectors have achieved a predetermined wipe length that provides a reliable electrical connection between corresponding electrical contacts. Such known sense pins could be used to detect whether the mated pair of electrical connectors have been de-mated beyond a distance at which the electrical performance of the assembly begins to degrade. But, the detection range of known sense pins is too broad. For example, the tips of known sense pins include guide features such as chamfers, fillets, and/or rounds that guide initial engagement between the sense pin and the corresponding electrical contact of the other electrical connector. Tolerance stack ups between the guide features and the corresponding electrical contact create an unreliable segment of the wipe length wherein the electrical connection between the sense pin and the corresponding electrical contact is intermittent. The unreliable segment of the wipe length may cause the sense pin to falsely indicate that the electrical contacts are still within a predetermined de-mating distance beyond which electrical performance degrades. Such a false indication may cause the electrical connector assembly to be unknowingly operated with degraded electrical performance. The unreliable segment of the wipe length may also cause the sense pin to falsely indicate that the electrical contacts are de-mated beyond the predetermined de-mating distance, which may cause the unnecessary diversion of the functionality of the electrical connector assembly to other resources.

A need remains for a sense pin having a more precise detection range for reliably indicating whether a mated pair of electrical connectors have been de-mated beyond a predetermined de-mating distance.

BRIEF DESCRIPTION OF THE INVENTION

In one embodiment, an electrical connector is provided for mating with a mating connector. The electrical connector includes a housing and electrical contacts held by the housing. The electrical contacts are configured to mate with corresponding mating contacts of the mating connector. A sense pin is held by the housing and is configured to mate with a corresponding mating contact of the mating connector. The sense pin extends a length that includes a tip segment and a sensing segment. The tip and sensing segments have different electrical characteristics. The tip segment includes a tip of the sense pin. The tip segment extends between the sensing segment and the tip such that the sensing segment is offset from the tip along the length of the sense pin. The sensing segment is configured to indicate that the electrical contacts and the mating contacts are de-mated by more than a predetermined de-mating distance.

In another embodiment, an electrical connector is provided for mating with a mating connector. The electrical connector includes a housing and electrical contacts held by the housing. The electrical contacts are configured to mate with corresponding mating contacts of the mating connector. A sense pin is held by the housing and configured to mate with a corresponding mating contact. The sense pin extends a length that includes a tip segment and an intermediate segment that extends from an end of the tip segment such that the tip segment extends between the intermediate segment and a tip of the sense pin. The end of the tip segment is positioned along the length of the sense pin such that the tip segment is moved into physical contact with the corresponding mating contact as the sense pin and the corresponding mating contact are de-mated beyond a predetermined de-mating distance. The physical contact between the tip segment and the corresponding mating contact opens or closes an electrical connection between the sense pin and the corresponding mating contact to thereby indicate that the electrical contacts and the mating contacts are de-mated by more than the predetermined de-mating distance.

In another embodiment, an electrical connector is provided for mating with a mating connector. The electrical connector includes a housing and electrical contacts held by the housing. The electrical contacts are configured to mate with corresponding mating contacts of the mating connector. A differential pair of sense pins is held by the housing and configured to mate with corresponding mating contacts. At least one of the sense pins of the differential pair includes a bridging spring that is disengaged from the other sense pin of the differential pair when the electrical and mating connectors are fully mated together. The bridging spring is configured to be moved into physical contact with the other sense pin of the differential pair as the differential pair of sense pins are de-mated from the corresponding mating contacts beyond a predetermined de-mating distance.

DETAILED DESCRIPTION OF THE INVENTION

Figure 1:
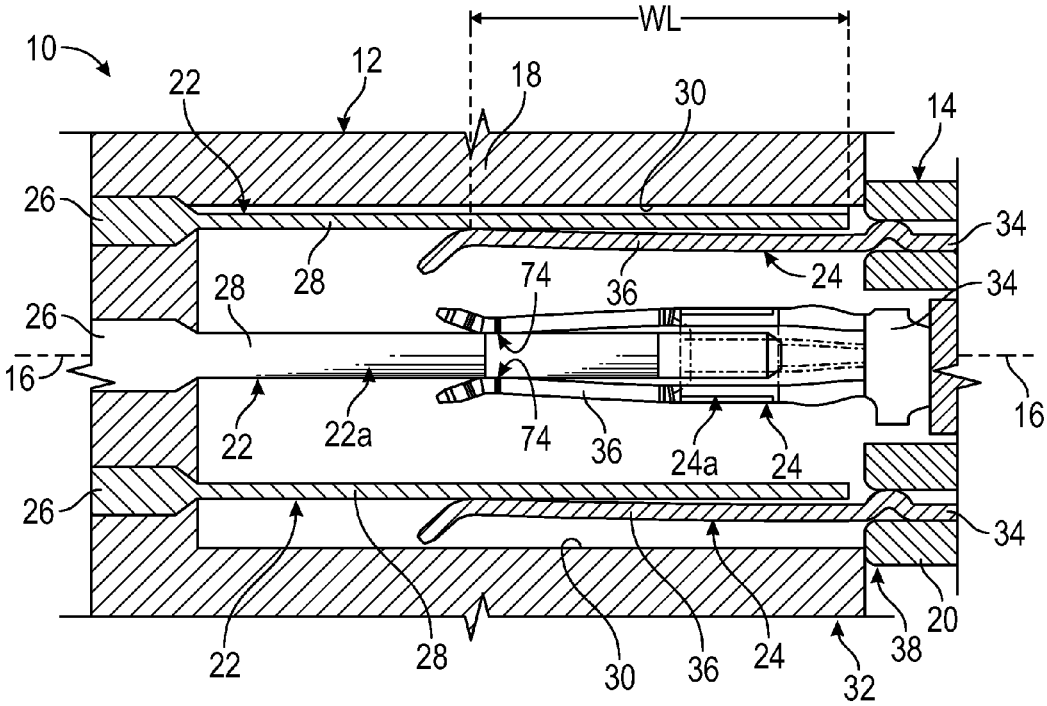
FIG. 1 is a cross-sectional view of an exemplary embodiment of an electrical connector assembly.
Figure 3:
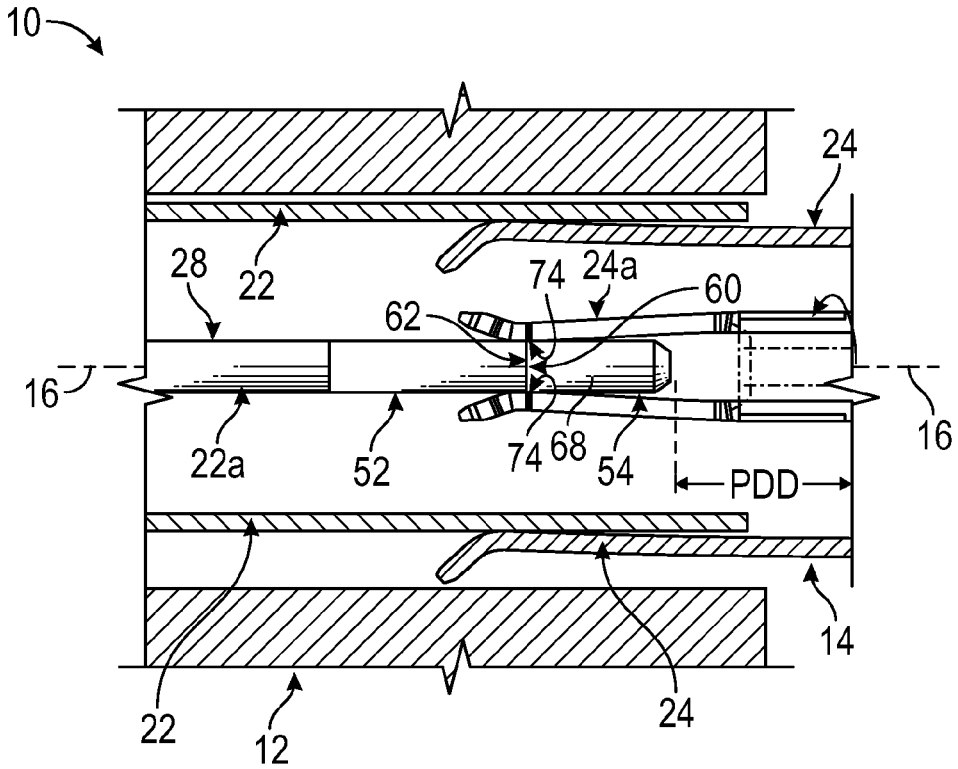
FIG. 3 is a cross-sectional view of the electrical connector assembly shown in FIG. 1 illustrating the electrical connectors of the assembly as partially de-mated from each other.

FIG. 1 is a cross-sectional view of an exemplary embodiment of an electrical connector assembly 10. The electrical connector assembly 10 includes electrical connectors 12 and 14 that are configured to mate together along a connection axis 16. The electrical connectors 12 and 14 include respective housings 18 and 20 and respective electrical contacts 22 and 24. When the electrical connectors 12 and 14 are mated together, the electrical contacts 22 of the electrical connector 12 are mated with corresponding electrical contacts 24 of the electrical connector 14, thereby establishing an electrical connection between the electrical connectors 12 and 14. As will be described in more detail below, one or more of the electrical contacts 22 of the electrical connector 12 is a sense pin 22*a* that is configured to indicate when the electrical connectors 12 and 14 are de-mated by more than a predetermined de-mating distance PDD (FIG. 3).

The electrical contacts 22 of the electrical connector 12 are held by the housing 18 of the electrical connector 12. Specifically, the electrical contacts 22 include bases 26 and mating segments 28 that extend from the bases 26. In the exemplary embodiment of the electrical connector 12, the bases 26 are held by the housing 18 and the housing 18 is configured such that the mating segments 28 extend within corresponding mating receptacles 30 of the housing 18. In addition or alternatively, one or more of the mating segments 28 extends outward from a mating end 32 of the housing 18, whether or not the mating segments) 28 is configured to be received within a corresponding mating receptacle (not shown) of the electrical connector 14.

The electrical contacts 24 of the electrical connector 14 include bases 34 and mating segments 36 that extend from the bases 34. The bases 34 of the electrical contacts 24 are held by the housing 20 and the housing 20 is configured such that the mating segments 36 extend outward from a mating end 38 of the housing 20 for being received within one or more corresponding mating receptacles 30 of the electrical connector 12. In addition or alternatively, one or more of the mating segments 36 extends outward from the mating end 38 but is not configured to be received within a corresponding mating receptacle 30 of the electrical connector 12. Moreover, in addition or alternatively to including mating segments 36 that extend outward from the mating end 38, the mating segment 36 of one or more electrical contacts 24 extends within a corresponding mating receptacle (not shown) of the housing 20 for mating with the corresponding electrical contact 22 within the mating receptacle. The electrical contacts 24 of the electrical connector 14 may be referred to herein as "mating contacts". The electrical connector 14 may be referred to herein as a "mating connector".

The electrical connectors 12 and 14 are shown in FIG. 1 in a fully mated position. To mate the electrical connectors 12 and 14 together as shown in FIG. 1, the housings 18 and 20 are brought towards each other along the connection axis 16. As the connectors 12 and 14 move towards each other, the electrical contacts 22 of the electrical connector 12 mate with the electrical contacts 24 of the electrical connector 14. Specifically, the mating segments 28 of the electrical contacts 22 move into physical contact with the mating segments 36 of the corresponding electrical contacts 24 of the electrical connector 14. As the connectors 12 and 14 continue to move towards the fully mated position shown in FIG. 1, the mating segments 28 slide along the corresponding mating segments 36, in physical contact therewith, until the mating segments 28 and 36 are in the fully mated positions shown in FIG. 1. The physical contact between the mating segments 28 and 36 establishes an electrical connection between the mating segments 38 and 36, and thus between the corresponding electrical contacts 22 and 24. By "mated", it is meant that corresponding mating segments 28 and 36 are engaged in physical contact such that an electrical connection is established having a predetermined reliability, strength, and/or the like. In the exemplary embodiment of the electrical connector assembly 10, the electrical contacts 24 of the electrical connector 14 mate with the electrical contacts 22 of the electrical connector 12 within the corresponding mating receptacles 30 of the electrical connector 12.

The electrical contacts 22 and 24 slide along each other along a wipe length WL. Specifically, the wipe length WL is defined by the distance along which the mating segments 28 and 36 slide in physical contact with each other. The dimension of the wipe length WL of the electrical contacts 22 and 24 may be selected as a distance that establishes an electrical connection between the corresponding mating segments 28 and 36 that has a predetermined reliability, strength, and/or the like. For example, the dimension of the wipe length WL may be selected such that the sliding physical contact between mating segments 28 and 36 wipes through oxidation and/or other surface layers of the mating segments 28 and 36 at one or more points of physical contact between the mating segments 28 and 36.

Although shown as abutting in the fully mated position shown in FIG. 1, the mating ends 32 and 38 of the housings 18 and 20, respectively, may not abut when the electrical connectors 12 and 14 are in the fully mated position. Moreover, in some embodiments, the mating end 32 of the housing 18 is received into a receptacle (not shown) of the mating end 38 of the housing 20, or vice versa, when the electrical connectors 12 and 14 are in the fully mated position. Each of the electrical connectors 12 and 14 may include any number of the respective electrical contacts 22 and 24. Moreover, the electrical connector 12 may include any number of the mating receptacles 30, each of which may hold any number of mating segments 28 and may receive any number of mating segments 36 therein. Each electrical contact 22 and each electrical contact 24 may be any type of electrical contact, such as, but not limited to, a signal contact, a ground contact, an electrical power contact, a sense contact, and/or the like.

Figure 2:
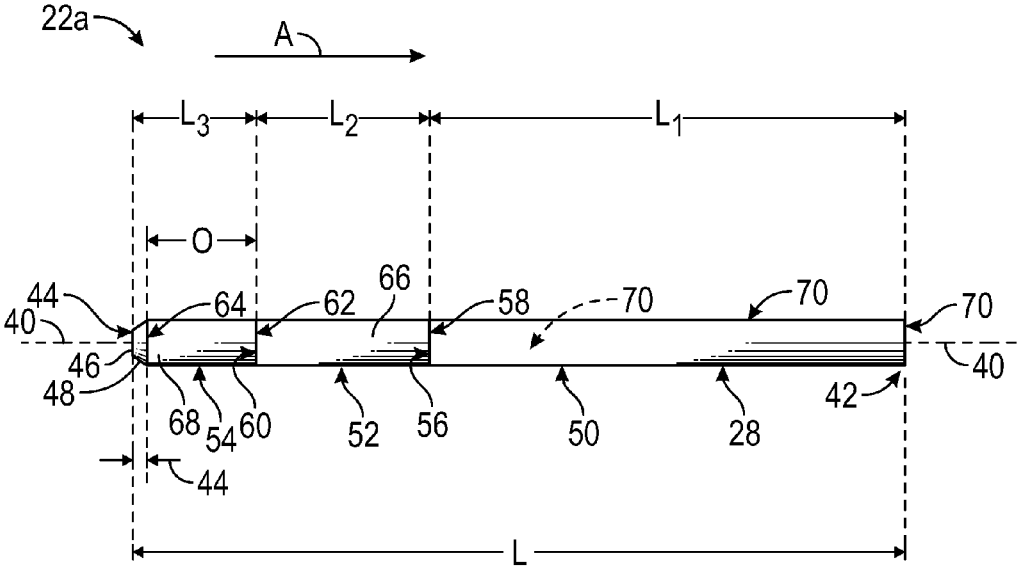
FIG. 2 is an elevational view of an exemplary embodiment of a sense pin of the electrical connector assembly shown in FIG. 1.

As briefly described above and will be described in more detail below, one or more of the electrical contacts 22 of the electrical connector 12 is a sense pin 22*a* that is configured to indicate when the electrical connectors 12 and 14 are de-mated by more than a predetermined de-mating distance PDD. The sense pin 22*a* is configured to mate with a corresponding electrical contact 24*a* of the electrical connector 14. FIG. 2 is an elevational view of an exemplary embodiment of a portion of the sense pin 22*a*. The base 26 (FIG. 1) of the sense pin 22*a* is not shown in FIG. 2. Rather, only the mating segment 28 of the sense pin 22*a* is shown in FIG. 2 for clarity. The mating segment 28 of the sense pin 22*a* extends a length L along a central longitudinal axis 40 from an end 42 of the mating segment 28 to a tip 44 of the sense pin 22*a*. The tip 44 includes a tip surface 46. The tip 44 optionally includes one or more guide features such as, but not limited to, a chamfer, a round, a fillet, and/or the like. In the exemplary embodiment of the sense pin 22*a*, the tip 44 includes a chamfer 48.

The length L of the mating segment 28 of the sense pin 22*a* includes a base segment 50, an intermediate segment 52, and a tip segment 54. Specifically, the base segment 50 extends a length $L_1$ from the base 26 of the sense pin 22*a* to an end 56 of the base segment 50. The base segment 50 includes the end 42 of the mating segment 28 of the sense pin 22*a*. The end 42 defines an end of the base segment 50 that is opposite the end 56. The intermediate segment 52 extends a length $L_2$ from an end 58 to an opposite end 60. The end 58 of the intermediate segment 52 extends from the end 56 of the base segment 50. The length $L_2$ of the intermediate segment 52 extends from the end 56 of the base segment 50 to the tip segment 54. In other words, the intermediate segment 52 extends between the base segment 50 and the tip segment 54 along the length L of the mating segment 28 of the sense pin 22*a*.

The tip segment 54 includes the tip 44 of the sense pin 22*a*. The tip segment 54 extends a length $L_3$ from an end 62 to the tip 44, and more specifically from the end 62 to the tip surface 46. The end 62 of the tip segment 54 extends from the end 60 of the intermediate segment 52. As can be seen in FIG. 2, the tip segment 54 extends between the intermediate segment 52 and the tip 44 along the length L of the mating segment 28 of the sense pin 22*a*. Accordingly, the intermediate segment 52 is displaced by an offset O from the tip 44 along the length L of the mating segment 28 of the sense pin 22*a* in the direction of the arrow A. Because the tip 44 includes the entirety of the chamfer 48 and the intermediate segment 52 is offset from the tip 44, the intermediate segment 52 is displaced by an offset O (in the direction A) from the chamfer 48 along the length L of the mating segment 28 of the sense pin 22*a*. The offset O may have any positive, non-zero, value.

In the exemplary embodiment of the sense pin 22*a*, the tip 44 extends a length that extends from an end 64 of the chamfer 48 to the tip surface 46. In other words, the end 64 of the chamfer 48 defines an interior end of the tip 44. Accordingly, in the exemplary embodiment of the sense pin 22*a*, the intermediate segment 52 is offset from both the chamfer 48 and the tip 44 by the same offset O (i.e., by the same distance). In embodiments wherein the end 64 of the chamfer 48 is not considered to define the interior end of the tip 44 (i.e., the length of the tip 44 is considered to extend past the end 64 of the chamfer 48 in the direction A), the intermediate segment 52 will be offset (in the direction A) from the interior end of the tip 44 and from the end 64 of the chamfer 48 by different distances. In such embodiments wherein the end 64 does not define the interior end of the tip 44, the intermediate segment 52 may be offset (in the direction A) from the interior end of the tip 44 by any positive, non-zero, distance and may be offset (in the direction A) from the end 64 of the chamfer 48 by any positive, non-zero, distance. It should be understood that in embodiments wherein the tip 44 includes another guide feature in addition or alternatively to the chamfer 48, the intermediate segment 52 will be offset from the other guide feature in a substantially similar manner to the offsets from the chamfer 48 described and/or illustrated herein (e.g., the offset O).

The intermediate segment 52 and the tip segment 54 include respective surface materials 66 and 68. The surface materials 66 and 68 have different electrical characteristics such that the intermediate segment 52 and the tip segment 54 have different electrical characteristics. Specifically, one of the segments 52 or 54 is electrically conductive at the surface thereof, while the other segment 52 or 54 is electrically non-conductive at the surface thereof. In the exemplary embodiment of the sense pin 22*a*, the surface material 66 of the intermediate segment 52 is electrically non-conductive such that the intermediate segment 52 is electrically non-conductive, while the surface material 68 of the tip segment 54 is electrically conductive such that the tip segment 54 is electrically conductive.

The surface materials 66 may be formed in any manner. For example, in some embodiments, the mating segment 28 of the sense pin 22*a* is defined by a body 70 that is electrically conductive and the surface material 66 of the intermediate segment 52 is defined by an electrically non-conductive coating that is formed on the body 70. In such embodiments wherein the body 70 is electrically conductive, the electrically conductive surface material 68 of the tip segment 54 may be defined by a surface of the body 70 or may be defined by an electrically conductive coating that is formed on the body 70. Moreover, and for example, in some embodiments the body 70 is electrically non-conductive and the surface material 68 of the tip segment 54 is defined by an electrically conductive coating that is formed on the body 70. In such embodiments wherein the body 70 is electrically non-conductive, the electrically non-conductive surface material 66 of the intermediate segment 52 may be defined by a surface of the body 70 or may be defined by an electrically non-conductive coating that is formed on the body 70. The surface material 66, the surface material 68, and the body 70 may each be fabricated from any material(s) that provide the surface material 66, the surface material 68, and the body 70 with the electrical characteristics described and/or illustrated herein.

As briefly described above, the sense pin 22*a* is configured to indicate when the electrical connectors 12 and 14 are de-mated by more than a predetermined de-mating distance PDD. Referring again to FIG. 1, the intermediate segment 52 of the sense pin 22*a* is in physical contact with the corresponding electrical contact 24*a* when the electrical connectors 12 and 14 are fully mated together. Specifically, the intermediate segment 52 is in physical contact with the electrical contact 24*a* at one or more contact regions 74 of the electrical contact 24*a* when the electrical connectors 12 and 14 are fully mated together. To de-mate the electrical connectors 12 and 14 from each other, the connectors 12 and 14 are moved apart from one another along the connection axis 16.

FIG. 3 is a cross-sectional view of the electrical connector assembly 10 illustrating the electrical connectors 12 and 14 as partially de-mated from each other. Specifically, the electrical connectors 12 and 14 are de-mated by slightly more than the predetermined de-mating distance PDD in FIG. 3. The predetermined de-mating distance PDD may be a distance beyond which the electrical performance of the electrical connector assembly 10 begins to degrade. Specifically, as the electrical connectors 12 and 14 are moved relatively apart along the connection axis 16 (i.e., de-mated) from the fully mated position shown in FIG. 1, the electrical contacts 22 of the electrical connector 12 remain electrically connected to the corresponding electrical contacts 24 of the electrical connector 14 until the electrical connectors 12 and 14 have moved away from each other by greater than the wipe length WL (FIG. 1). Once the electrical connectors 12 and 14 have moved away from each other by a de-mating distance that is greater than the wipe length WL, the electrical contacts 22 are disengaged from physical contact with the corresponding electrical contacts 24 such that there is no electrical connection between the electrical contacts 22 and 24. The electrical connectors 12 and 14 are thereby fully de-mated. But, as the electrical connectors 12 and 14 are being de-mated but are not yet separated by the full de-mating distance, the electrical contacts 22 may remain electrically connected to the corresponding electrical contacts 24, although the electrical performance of the electrical connector assembly 10 will begin to degrade. For example, electrical performance degradation of the electrical connector assembly 10 may include, but is not limited to, a reduction in the speed, quality, strength, amount, number, and/or the like of electrical signals transmitted through the assembly 10, a reduction in the speed, quality, strength, amount, and/or the like of electrical power transmitted through the assembly 10, and/or the like.

In the exemplary embodiment of the electrical connector assembly 10, the predetermined de-mating distance PDD is the de-mating distance beyond which the electrical performance of the electrical connector assembly 10 begins to degrade. In other words, the predetermined de-mating distance PDD is the upper limit of the de-mating distance before the performance of the electrical connector assembly 10 begins to degrade. It should be appreciated that because the electrical contacts 22 and 24 are still engaged in physical and electrical contact with each other at the predetermined de-mating distance PDD, the pre-determined de-mating distance PDD is less than the wipe length WL of the electrical contacts 22 and 24.

As the connectors 12 and 14 are de-mated from each other along the connection axis 16 from the fully mated position shown in FIG. 1 toward the partially de-mated position shown in FIG. 3, the contact regions 74 of the electrical contact 24*a* slide along, in physical contact with, the intermediate segment 52 of the sense pin 22*a*. The transition between the intermediate segment 52 and the tip segment 54 is positioned along the length L of the sense pin 22*a* at a position that corresponds to the predetermined de-mating distance PDD. Specifically, the end 60 of the intermediate segment 52 is positioned along the length L (FIG. 2) of the mating segment 28 of the sense pin 22*a* such that the intermediate segment 52 is moved out of physical contact with (i.e., disengaged from) the contact regions 74 of the electrical contact 24*a* as the sense pin 22*a* and the electrical contact 24*a* are de-mated beyond the predetermined de-mating distance PDD. Similarly, the end 62 of the tip segment 54 is positioned along the length L of the mating segment 28 of the sense pin 22*a* such that the tip segment 54 is moved into physical contact with the contact regions 74 of the electrical contact 24*a* as the sense pin 22*a* and the electrical contact 24*a* are de-mated beyond the predetermined de-mating distance PDD.

The electrical connectors 12 and 14 are shown in FIG. 3 as being de-mated by slightly more than the predetermined de-mating distance PDD. Specifically, the contact regions 74 of the electrical contact 24*a* are engaged in physical contact with the tip segment 54 of the sense pin 22*a* but are disengaged from the intermediate segment 52 of the sense pin 22*a*. In the exemplary embodiment of the electrical connector assembly 10, the physical contact between the contact regions 74 of the electrical contact 24*a* and the electrically conductive surface material 68 of the tip segment 54 closes an electrical connection between the sense pin 22*a* and the electrical contact 24*a*. The closing of the electrical connection indicates that the electrical contacts 22 of the electrical connector 12 are de-mated from the corresponding electrical contacts 24 of the electrical connector 14 by more than the predetermined de-mating distance PDD. Accordingly, the intermediate segment 52 is configured to indicate that the electrical contacts 22 and 24 are de-mated by more than the predetermined de-mating distance PDD by disengaging from physical contact with the contact regions 74 of the electrical contact 24*a*. Specifically, as the contact regions 74 cross the transition between the intermediate segment 52 and the tip segment 54, the contact regions 74 disengage from physical contact with the intermediate segment 52 and engage in physical contact with the tip segment 54 to thereby close the electrical connection between the sense pin 22*a* and the electrical contact 24*a*. The base 26 (FIG. 1) of the sense pin 22*a* may be operatively connected to a processor, logic, controller, computer, circuit, and/or like for receiving and processing the indication (i.e., the closing of the electrical connection) from the sense pin 22*a*.

Because the intermediate segment 52 of the sense pin 22*a* is configured to indicate that the electrical contacts 22 and 24 are de-mated by more than the predetermined de-mating distance PDD by disengaging from physical contact with the contact regions 74 of the electrical contact 24*a*, the intermediate segment 52 may be considered, and referred to herein, as a "sensing segment" of the sense pin 22*a*.

Figure 4:
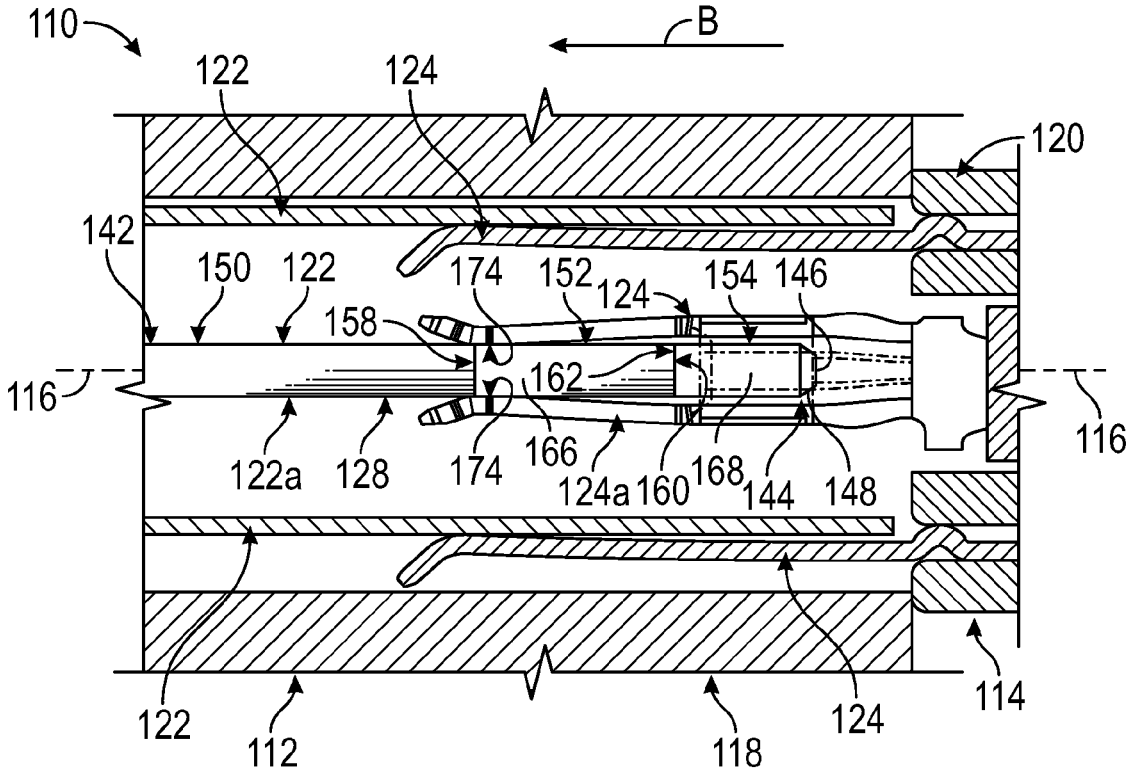
FIG. 4 is a cross-sectional view of another exemplary embodiment of an electrical connector assembly.
Figure 5:
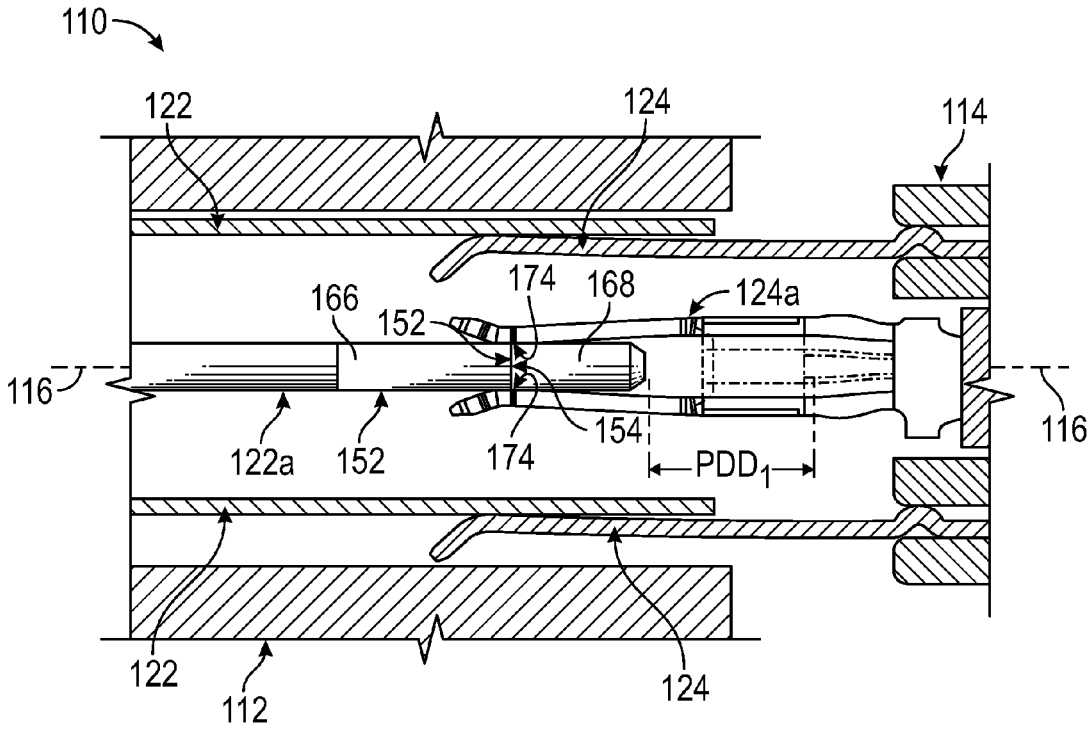
FIG. 5 is a cross-sectional view of the electrical connector assembly shown in FIG. 4 illustrating the electrical connectors of the assembly as partially de-mated from each other.

FIG. 4 is a cross-sectional view of another exemplary embodiment of an electrical connector assembly 110. The electrical connector assembly 110 includes electrical connectors 112 and 114 that are configured to mate together along a connection axis 116. The electrical connectors 112 and 114 include respective housings 118 and 120 and respective electrical contacts 122 and 124. One or more of the electrical contacts 122 of the electrical connector 112 is a sense pin 122*a* that is configured to indicate when the electrical connectors 112 and 114 are de-mated beyond a predetermined de-mating distance $PDD_1$ (FIG. 5). The electrical contacts 124 of the electrical connector 114 may be referred to herein as "mating contacts". The electrical connector 114 may be referred to herein as a "mating connector".

The sense pin 122*a* includes a mating segment 128 that extends a length from an end 142 of the mating segment 128 to a tip 144 of the sense pin 122*a*. The tip 144 includes a tip surface 146. The tip 144 optionally includes one or more guide features, such as, but not limited to, a chamfer, a round, a fillet, and/or the like. In the exemplary embodiment of the sense pin 122*a*, the tip 144 includes a chamfer 148. The length of the mating segment 128 of the sense pin 122*a* includes a base segment 150, an intermediate segment 152, and a tip segment 154. The intermediate segment 152 extends a length from an end 158 to an opposite end 160. The intermediate segment 152 extends between the base segment 150 and the tip segment 154 along the length of the mating segment 128 of the sense pin 122*a*.

The tip segment 154 includes the tip 144 of the sense pin 122*a*. The tip segment 154 extends a length from an end 162 to the tip 144, and more specifically from the end 162 to the tip surface 146. The tip segment 154 extends between the intermediate segment 152 and the tip 144 along the length of the mating segment 128 of the sense pin 122*a*. Accordingly, the intermediate segment 152 is offset from the tip 144 along the length of the mating segment 128 of the sense pin 122*a* in the direction of the arrow B. Because the tip 144 includes the entirety of the chamfer 148 and the intermediate segment 152 is offset from the tip 144, the intermediate segment 152 is offset (in the direction B) from the chamfer 148 along the length of the mating segment 128 of the sense pin 122*a*.

The intermediate segment 152 and the tip segment 154 include respective surface materials 166 and 168. In the exemplary embodiment of the sense pin 122*a*, the surface material 166 of the intermediate segment 152 is electrically conductive such that the intermediate segment 152 is electrically conductive, while the surface material 168 of the tip segment 154 is electrically non-conductive such that the tip segment 54 is electrically non-conductive.

As can be seen in FIG. 4, the intermediate segment 152 of the sense pin 122*a* is in physical contact with the corresponding electrical contact 124*a* of the electrical connector 114 when the electrical connectors 112 and 114 are fully mated together. Specifically, the intermediate segment 152 is in physical contact with the electrical contact 124*a* at one or more contact regions 174 of the electrical contact 124*a* when the electrical connectors 112 and 114 are fully mated together.

FIG. 5 is a cross-sectional view of the electrical connector assembly 110 illustrating the electrical connectors 112 and 114 as partially de-mated from each other. Specifically, the electrical connectors 112 and 114 are de-mated by slightly more than the predetermined de-mating distance $PDD_1$ in FIG. 5. The predetermined de-mating distance $PDD_1$ may be a distance beyond which the electrical performance of the electrical connector assembly 110 begins to degrade.

The transition between the intermediate segment 152 and the tip segment 154 is positioned along the length of the sense pin 122*a* at a position that corresponds to the predetermined de-mating distance $PDD_1$. As the connectors 112 and 114 are de-mated from each other along the connection axis 116 from the fully mated position shown in FIG. 4 toward the partially de-mated position shown in FIG. 5, the contact regions 174 of the electrical contact 124*a* slide along, in physical contact with, the intermediate segment 152 of the sense pin 122*a*. As the connectors 112 and 114 move beyond the predetermined de-mating distance $PDD_1$, the intermediate segment 152 is moved out of physical contact with (i.e., disengaged from) the contact regions 174 of the electrical contact 124*a* and the tip segment 154 is moved into physical contact with the contact regions 174. The electrical connectors 112 and 114 are shown in FIG. 5 as being de-mated by slightly more than the predetermined de-mating distance $PDD_1$.

The physical contact between the contact regions 174 of the electrical contact 124*a* and the electrically non-conductive surface material 168 of the tip segment 154 opens an electrical connection between the sense pin 122*a* and the electrical contact 124*a*. The opening of the electrical connection indicates that the electrical contacts 122 of the electrical connector 112 are de-mated from the corresponding electrical contacts 124 of the electrical connector 114 beyond the predetermined de-mating distance $PDD_1$. Accordingly, the intermediate segment 152 is configured to indicate that the electrical contacts 122 and 124 are de-mated beyond the predetermined de-mating distance $PDD_1$ by disengaging from electrical contact with the contact regions 174 of the electrical contact 124*a*. Specifically, as the contact regions 174 cross the transition between the intermediate segment 152 and the tip segment 154, the contact regions 74 disengage from physical contact with the intermediate segment 52 and thereby open the electrical connection between the sense pin 122*a* and the electrical contact 124*a*.

Because the intermediate segment 152 of the sense pin 122*a* is configured to indicate that the electrical contacts 122 and 124 are de-mated beyond the predetermined de-mating distance $PDD_1$ by disengaging from electrical contact with the contact regions 174 of the electrical contact 124*a*, the intermediate segment 152 may be considered, and referred to herein, as a "sensing segment" of the sense pin 122*a*.

Figure 6:
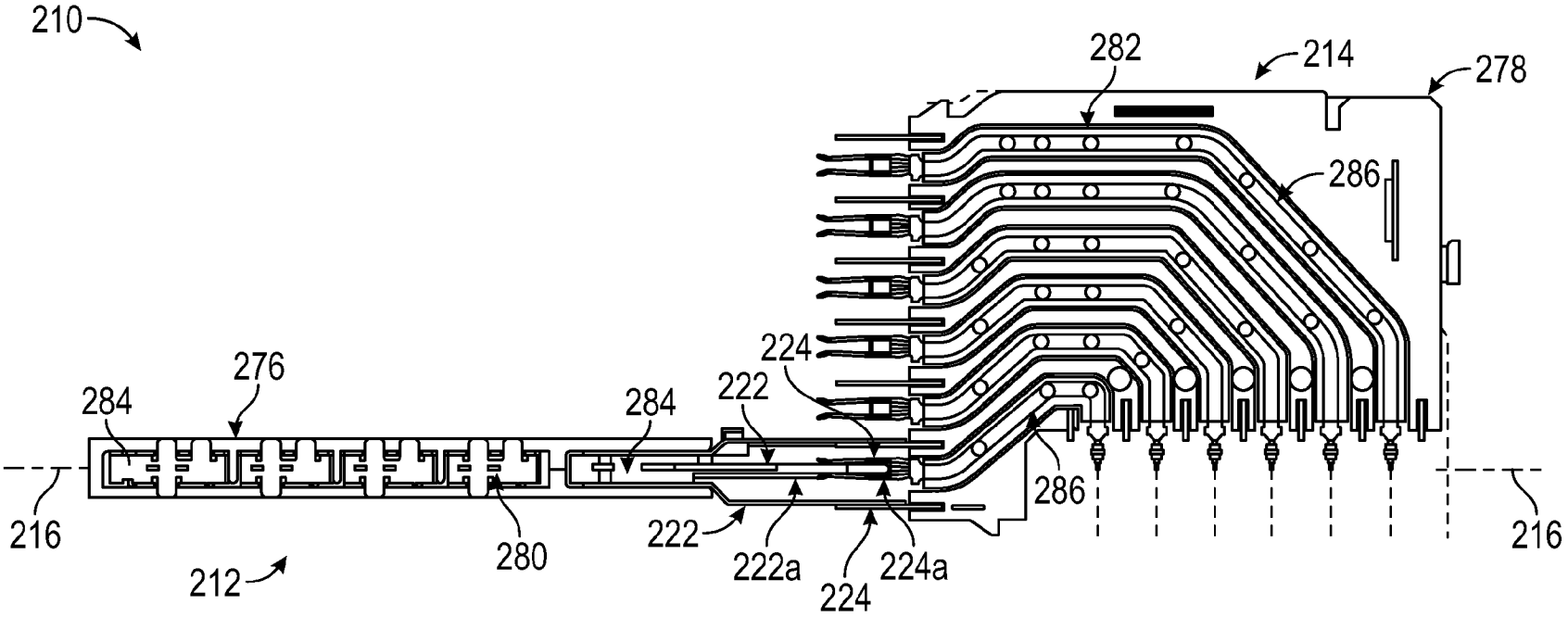
FIG. 6 is an elevational view of a portion of another exemplary embodiment of an electrical connector assembly.

FIG. 6 is an elevational view of another exemplary embodiment of an electrical connector assembly 210. The electrical connector assembly 210 includes electrical connectors 212 and 214 that are configured to mate together along a connection axis 216. The electrical connectors 212 and 214 include housings (not shown) and respective electrical contacts 222 and 224. The housing of each electrical connector 212 and 214 holds one or more respective contact modules 276 and 278. Each contact module 276 and 278 includes a respective lead frame 280 and 282 and a respective electrically non-conductive body 284 and 286 that extends over the lead frame 280 and 282, respectively. In some embodiments, the non-conductive body 284 and/or 286 is an overmold that is molded over the respective lead frame 280 and/or 282. The contact modules 276 and 278 include the respective electrical contacts 222 and 224. Optionally, the electrical contacts 224 are arranged in differential pairs and/or the electrical contacts 226 are arranged in differential pairs. The electrical contacts 224 of the electrical connector 214 may be referred to herein as "mating contacts". The electrical connector 214 may be referred to herein as a "mating connector". The bodies 284 and 286 each may be considered and/or referred to herein as a "housing" of the respective electrical connector 212 and 214.

Figure 7:
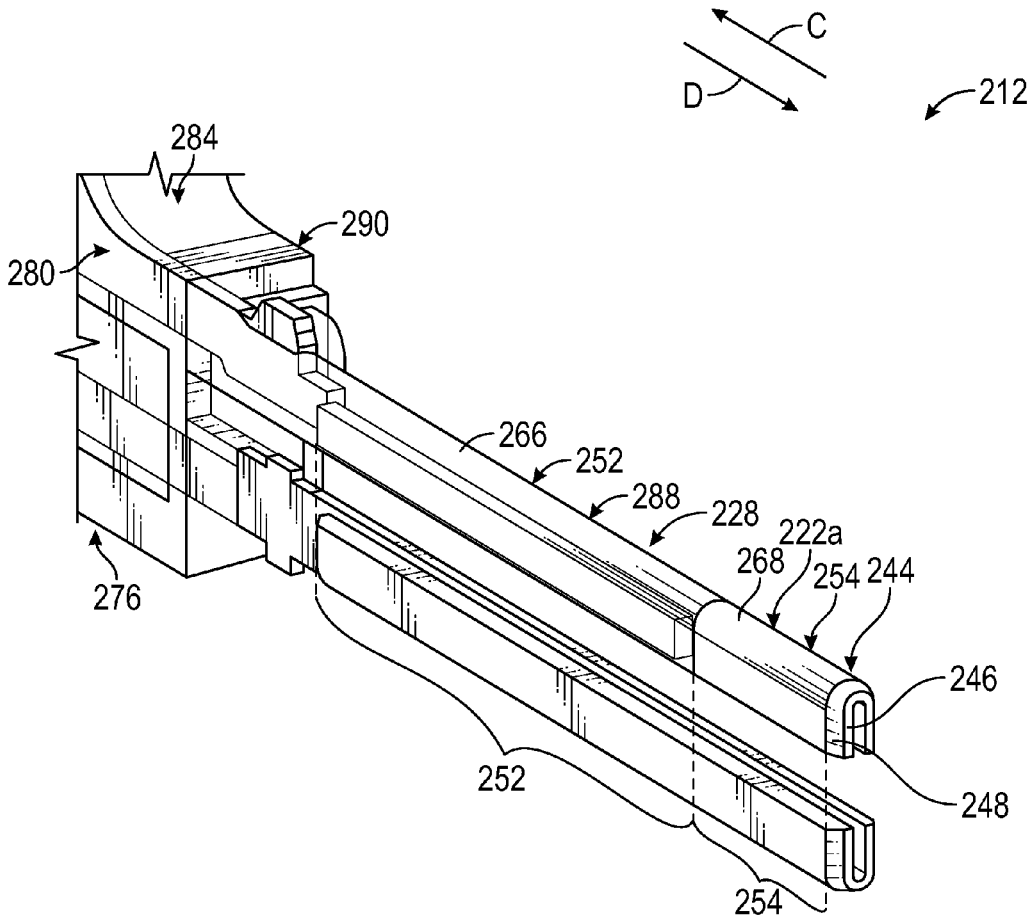
FIG. 7 is a perspective view of a portion of an exemplary embodiment of an electrical connector of the electrical connector assembly shown in FIG. 6.

FIG. 7 is a perspective view of a portion of the electrical connector 212 of the electrical connector assembly 210. One or more of the electrical contacts 222 of the electrical connector 212 is a sense pin 222*a* that is configured to indicate when the electrical connectors 212 and 214 are de-mated by more than a predetermined de-mating distance. The sense pin 222*a* includes a mating segment 228 that extends a length, which includes a tip 244 having a tip surface 246. The tip 244 optionally includes one or more guide features, such as, but not limited to, a chamfer, a round, a fillet, and/or the like. In the exemplary embodiment of the sense pin 222*a*, the tip 244 includes a chamfer 248. The length of the mating segment 228 of the sense pin 222*a* includes an intermediate segment 252 and a tip segment 254. The tip segment 254 includes the tip 244 of the sense pin 222*a*. The tip segment 254 extends between the intermediate segment 252 and the tip 244 along the length of the mating segment 228 of the sense pin 222*a*. Accordingly, the intermediate segment 252 is offset from the tip 244 along the length of the mating segment 228 of the sense pin 222*a* in the direction of the arrow C. Because the tip 244 includes the entirety of the chamfer 248 and the intermediate segment 252 is offset from the tip 244, the intermediate segment 252 is offset (in the direction C) from the chamfer 248 along the length of the mating segment 228 of the sense pin 222*a*.

The intermediate segment 252 and the tip segment 254 include respective surface materials 266 and 268. As can be seen in FIG. 7, the surface material 266 of the intermediate segment 252 is defined by an extension 288 of the electrically non-conductive body 284 of the contact module 276 of the electrical connector 212. Specifically, the extension 288 of the body 284 extends outward along the length of the mating segment 228 in the direction of the arrow D from a main segment 290 of the body 284 that extends over the lead frame 280. Accordingly, in the exemplary embodiment of the sense pin 222*a*, the surface material 266 of the intermediate segment 252 is electrically non-conductive such that the intermediate segment 252 is electrically non-conductive. The surface material 268 of the tip segment 254 is electrically conductive in the exemplary embodiment of the sense pin 222*a*. Operation of the sense pin 222*a* to indicate when the electrical connectors 212 and 214 are de-mated by more than the predetermined de-mating distance is substantially similar to the sense pin 22*a* (FIGS. 1-3) and therefore will not be described in more detail herein. The intermediate segment 252 may be considered, and referred to herein, as a "sensing segment" of the sense pin 222*a*.

Figure 8:
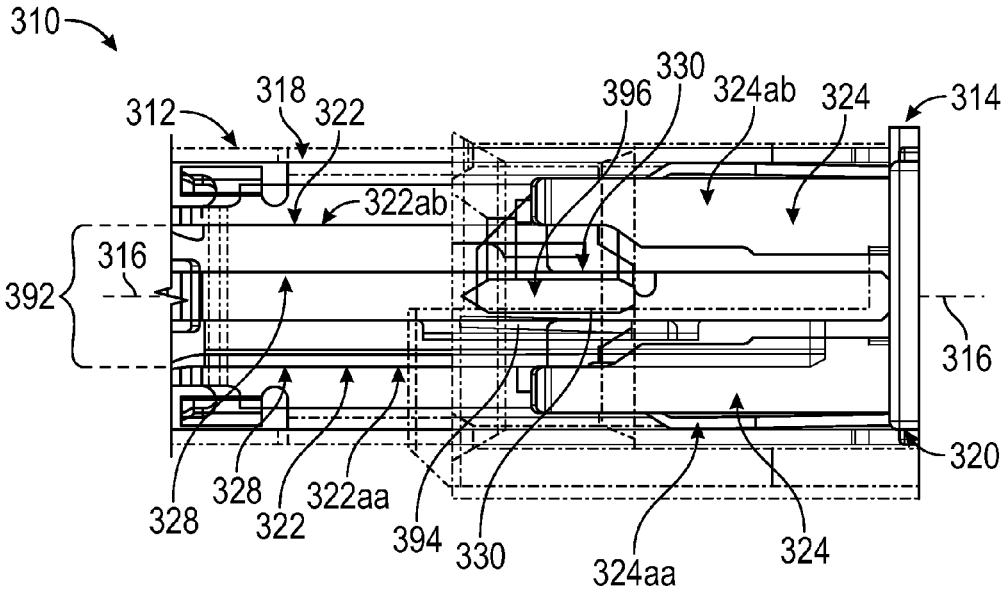
FIG. 8 is a cross-sectional view of another exemplary embodiment of an electrical connector assembly.

FIG. 8 is a cross-sectional view of another exemplary embodiment of an electrical connector assembly 310. The electrical connector assembly 310 includes electrical connectors 312 and 314 that are configured to mate together along a connection axis 316. The electrical connectors 312 and 314 include respective housings 318 and 320 and respective electrical contacts 322 and 324. The electrical contacts 224 of the electrical connector 214 may be referred to herein as "mating contacts". The electrical connector 214 may be referred to herein as a "mating connector".

Figure 9:
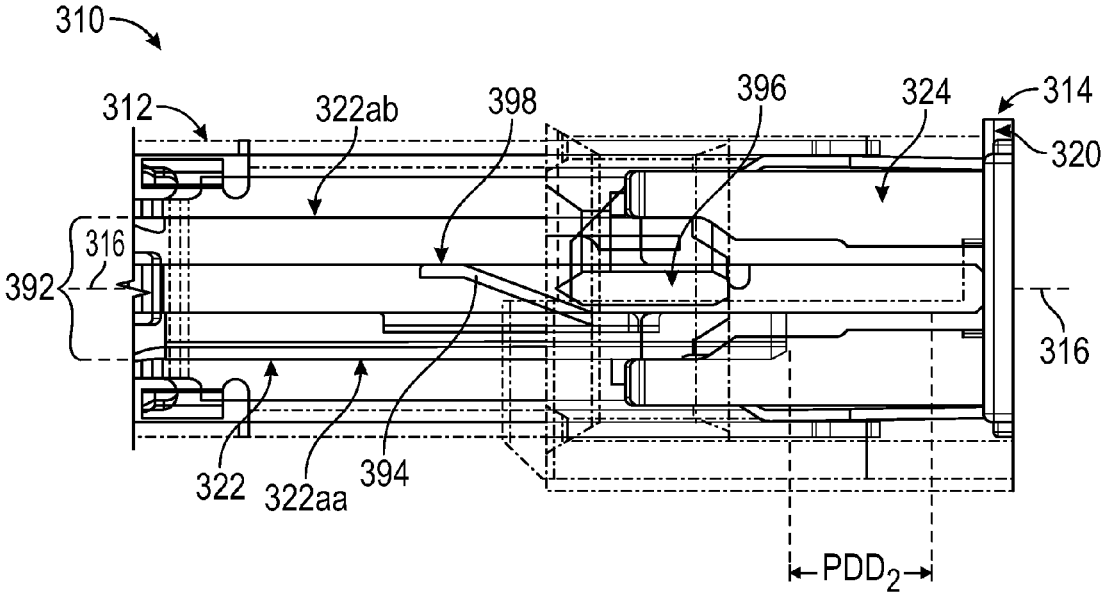
FIG. 9 is a cross-sectional view of the electrical connector assembly shown in FIG. 8 illustrating the electrical connectors of the assembly as partially de-mated from each other.

The electrical connector 312 includes one or more differential pairs 392 of sense pins 322*aa* and 322*ab* configured to indicate when the electrical connectors 312 and 314 are de-mated by more than a predetermined de-mating distance $PDD_2$ (FIG. 9). The sense pins 322*aa* and 322*ab* of the differential pair 392 include mating segments 328 that are configured to mate with corresponding electrical contacts 324*aa* and 324*ab* of the electrical connector 314. The sense pin 322*aa* and/or the sense pin 322*ab* include a bridging spring 394. In the exemplary embodiment of the electrical connector 312, only the sense pin 322*aa* includes a bridging spring 394. But, it should be understood that the sense pin 322*ab* may include a bridging spring 394 in addition or alternative to the sense pin 322*aa*.

The bridging spring 394 is biased to an extended position shown in FIG. 9. In the extended position, the bridging spring 394 is configured to physically contact the other sense pin 322*ab* of the differential pair 392 to electrically connect the sense pins 322*aa* and 322*ab* together, as will be described below. FIG. 8 illustrates the electrical connectors 312 and 314 as fully mated together. When fully mated together as shown in FIG. 8, the bridging spring 394 is held in a retracted position against the natural bias of the bridging spring 394 to the extended position. In the retracted position, the bridging spring 394 is disengaged from (i.e., not in physical contact with) the other sense pin 322*ab* of the differential pair 392. As can be seen in FIG. 8, a segment 396 of the housing 320 of the electrical connector 314 is engaged in physical contact with the bridging spring 394 to hold the bridging spring 394 in the retracted position. As should be apparent from FIG. 8, the segment 396 of the housing 320 engages the bridging spring 394 as the connectors 312 and 314 are mated together to move the bridging spring 394 from the extended position to the retracted position against the natural bias of the bridging spring 394. In the exemplary embodiment of the electrical connector 314, the housing segment 396 is divider that separates two adjacent mating receptacles 330 of the housing 320. But, the segment 396 may additionally or alternatively be any other segment of the housing 320.

FIG. 9 is a cross-sectional view of the electrical connector assembly 310 illustrating the electrical connectors 312 and 314 as partially de-mated from each other. Specifically, the electrical connectors 312 and 314 are de-mated by slightly more than the predetermined de-mating distance $PDD_2$. The predetermined de-mating distance $PDD_2$ may be a distance beyond which the electrical performance of the electrical connector assembly 310 begins to degrade.

As the connectors 312 and 314 are de-mated from each other along the connection axis 316 from the fully mated position shown in FIG. 8 toward the partially de-mated position shown in FIG. 9, a tip 398 of the bridging spring 394 clears the segment 396 of the housing 320. As the bridging spring 394 continues to clear the segment 396, the natural bias of the bridging spring 394 moves the bridging spring 394 from the retracted position toward the extended position. As the connectors 312 and 314 move beyond the predetermined de-mating distance $PDD_2$, the tip 398 of the bridging spring 394 is moved into physical contact with the other sense pin 322*ab* of the differential pair 392. The physical contact between the tip 398 of the bridging spring 394 and the other sense pin 322*ab* closes an electrical connection between the sense pins 322*aa* and 322*ab* of the differential pair 392, which indicates that the electrical contacts 322 of the electrical connector 312 are de-mated from the corresponding electrical contacts 324 of the electrical connector 314 by more than the predetermined de-mating distance $PDD_2$.

The embodiments described and/or illustrated herein may provide a sense pin having a more precise detection range, as compared to at least some known sense pins, for reliably indicating whether a mated pair of electrical connectors have been de-mated beyond a predetermined de-mating distance. For example, the embodiments described and/or illustrated herein may offset the sensing segment of a sense pin from a guide feature of the sense pin. Moreover, and for example, the embodiments described and/or illustrated herein may reduce or eliminate an unreliable segment of wipe length from the sensing segment of the sense pin. In other words, and for example, the embodiments described and/or illustrated herein may move the sensing segment of a sense pin to a segment of the wipe length that provides a more reliable electrical connection.

The embodiments described and/or illustrated herein may reduce or eliminate false indications that the electrical contacts of an electrical connector assembly are still within a predetermined de-mating distance beyond which electrical performance degrades, which may prevent the electrical connector assembly from being unknowingly operated with degraded electrical performance. The embodiments described and/or illustrated herein may reduce or eliminate false indications that the electrical contacts of an electrical connector assembly are de-mated beyond a predetermined de-mating distance, which may prevent unnecessary diversion of the functionality of the electrical connector assembly to other resources.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mating with a mating connector, the electrical connector comprising:

a housing;

electrical contacts held by the housing, the electrical contacts being configured to mate with mating contacts of the mating connector; and a sense pin held by the housing and being configured to mate with a corresponding mating contact of the mating connector, the sense pin extending a length that includes a tip segment and a sensing segment, the tip and sensing segments having different electrical characteristics, the tip segment including a tip of the sense pin, the tip segment extending between the sensing segment and the tip of the sense pin such that the sensing segment is axially offset from the tip along the length of the sense pin, wherein the sensing segment is configured to indicate that the electrical contacts and the mating contacts are de-mated by more than a predetermined de-mating distance.

2. The electrical connector of claim 1, wherein the sensing segment of the sense pin is in physical contact with the corresponding mating contact when the electrical and mating connectors are fully mated together, and wherein the sensing segment is configured to indicate that the electrical contacts and the mating contacts are de-mated by more than the predetermined de-mating distance by disengaging from the corresponding mating contact as the electrical and mating connectors are de-mated.

3. The electrical connector of claim 1, wherein the sensing segment is configured to indicate that the electrical contacts and the mating contacts are de-mated by more than the predetermined de-mating distance via opening or closing of an electrical connection between the sense pin and the corresponding mating contact.

4. The electrical connector of claim 1, wherein the tip segment of the sense pin has a conductive surface material such that the electrical characteristic of the tip segment is conductivity, the sensing segment of the sense pin having a non-conductive surface material such that the electrical characteristic of the sensing segment is non-conductivity.

5. The electrical connector of claim 1, wherein the sensing segment of the sense pin has a conductive surface material such that the electrical characteristic of the sensing segment is conductivity, the tip segment of the sense pin having a non-conductive surface material such that the electrical characteristic of the tip segment is non-conductivity.

6. The electrical connector of claim 1, further comprising a contact module held by the housing, the contact module comprising a lead frame and a non-conductive body that extends over the lead frame, the electrical contacts being held by the contact module, wherein the sensing segment of the sense pin is defined by an extension of the non-conductive body of the contact module.

7. The electrical connector of claim 1, wherein the predetermined de-mating distance is a distance beyond which an electrical performance of the electrical and mating connectors begins to degrade.

8. The electrical connector of claim 1, wherein the predetermined de-mating distance is less than a wipe length of the electrical contacts.

9. The electrical connector of claim 1, wherein the tip comprises a guide feature such that the sensing segment is axially offset along the length of the sense pin from the guide feature.

10. An electrical connector for mating with a mating connector, the electrical connector comprising:

a housing;

electrical contacts held by the housing, the electrical contacts being configured to mate with mating contacts of the mating connector; and a sense pin held by the housing and configured to mate with a corresponding mating contact of the mating connector, the sense pin extending a length that includes a tip segment and an intermediate segment that extends from an end of the tip segment such that the tip segment extends between the intermediate segment and a tip of the sense pin, wherein the end of the tip segment is positioned along the length of the sense pin such that the tip segment is moved into physical contact with the corresponding mating contact as the sense pin and the corresponding mating contact are de-mated beyond a predetermined de-mating distance, and wherein the physical contact between the tip segment and the corresponding mating contact opens or closes an electrical connection between the sense pin and the corresponding mating contact to thereby indicate that the electrical contacts and the mating contacts are de-mated by more than the predetermined de-mating distance.

11. The electrical connector of claim 10, wherein the tip segment of the sense pin has a conductive surface and the intermediate segment of the sense pin has a non-conductive surface, the physical contact between the tip segment and the corresponding mating contact closing the electrical connection between the sense pin and the corresponding mating contact to thereby indicate that the electrical contacts and the mating contacts are de-mated by more than the predetermined de-mating distance.

12. The electrical connector of claim 10, wherein the tip segment of the sense pin has a non-conductive surface and the intermediate segment of the sense pin has a conductive surface, the physical contact between the tip segment and the corresponding mating contact opening the electrical connection between the sense pin and the corresponding mating contact to thereby indicate that the electrical contacts and the mating contacts are de-mated by more than the predetermined de-mating distance.

13. The electrical connector of claim 10, further comprising a contact module held by the housing, the contact module comprising a lead frame and a non-conductive body that extends over the lead frame, the electrical contacts being held by the contact module, wherein the intermediate segment of the sense pin is defined by an extension of the non-conductive body of the contact module.

14. The electrical connector of claim 10, wherein the predetermined de-mating distance is less than a wipe length of the electrical contacts.

15. The electrical connector of claim 10, wherein the tip of the sense pin comprises a guide feature, the end of the tip segment being axially offset along the length of the sense pin from the guide feature.

16. The electrical connector of claim 10, wherein the predetermined de-mating distance is a distance beyond which an electrical performance of the electrical and mating connectors begins to degrade.

* * * * *